United States Patent [19]

Blacker, Jr. et al.

[11] 3,995,194

[45] Nov. 30, 1976

[54] ELECTRON GUN HAVING AN EXTENDED FIELD ELECTROSTATIC FOCUS LENS

[75] Inventors: Allen Palmer Blacker, Jr., Hoffman Estates; James W. Schwartz, Deerfield, both of Ill.

[73] Assignee: Zenith Radio Corporation, Chicago, Ill.

[22] Filed: Aug. 2, 1974

[21] Appl. No.: 494,123

[52] U.S. Cl. ..... 315/16; 315/382; 315/31 TV; 313/449

[51] Int. Cl.[2] ..... H01J 29/46; H01J 29/56

[58] Field of Search ..... 315/15, 16, 31 R, 31 TV, 315/382; 313/449

[56] References Cited

UNITED STATES PATENTS

| | | | |
|---|---|---|---|
| 2,227,034 | 12/1940 | Schlesinger | 315/14 |
| 2,931,937 | 4/1960 | Dufour | 315/16 |
| 2,971,118 | 2/1961 | Burdick | 313/449 |
| 3,090,882 | 5/1963 | Benway | 313/449 |
| 3,411,029 | 11/1968 | Karr | 313/463 |
| 3,732,457 | 5/1973 | Ueno et al. | 315/15 |

*Primary Examiner*—Maynard R. Wilbur
*Assistant Examiner*—T. M. Blum
*Attorney, Agent, or Firm*—John H. Coult

[57] ABSTRACT

A television cathode ray tube has associated therewith a power supply for developing discrete supply voltages. A general purpose electron gun is depicted for receiving supply voltages from the power supply to produce a sharply focused beam of electrons at the cathode ray tube screen. The gun comprises associated cathode means and grid means for producing a beam of electrons, and novel focus lens means. The focus lens means receives electrons from the cathode means and a predetermined pattern of voltages from the power supply and comprises at least three electrodes for establishing a single, continuous electrostatic focusing field characterized by having an axial potential distribution which, at all times during tube operation, decreases smoothly and monotonically from a relatively intermediate potential to a relatively low potential spatially located at a lens intermediate position, and then increases smoothly, directly and monotonically from said relatively low potential to a relatively high potential.

25 Claims, 11 Drawing Figures

ELECTRON GUN HAVING AN EXTENDED FIELD ELECTROSTATIC FOCUS LENS

CROSS-REFERENCE TO RELATED APPLICATION

This application is related to but not dependent upon application Ser. No. 408,720, filed Oct. 23, 1973, now U.S. Pat. No. 3,895,253, assigned to the assignee of the present invention.

BACKGROUND OF THE INVENTION

This invention concerns electron guns of the type used in television cathode ray tubes, particular emphasis being placed on the focus lens portion of such guns.

Electron guns employed in television cathode ray tubes generally comprise two basic sections: (1) an electron beam source, and (2) an electron beam focus lens for focusing the electron beam on the phosphor-bearing screen of the cathode ray tube. Most commercially employed focus lenses are of the electrostatic variety and generally are embodied as discrete, conductive, tubular elements which are arranged coaxially and which have a predetermined pattern of voltages thereon to establish the electrostatic focusing field. One commerically accepted class of such electrostatic focusing lens has been, and continues to be, the bipotential lens. The term "bipotential lens" is used herein to describe a lens, generally comprising two electrodes, which presents to electrons traveling down the lens axis from the source toward the screen target, an axial potential distribution which increases monotonically from an initial low potential near the source to a final high potential, as shown diagrammatically in FIG. 7A. The axial potential distribution of a bipotential lens of this type is said to be "monotonic" since its first derivative does not change sign.

As a class, however, the bipotential lens suffers from having undesirably poor spherical aberration characteristics and can not, in a reasonably small space such as is available in a cathode ray tube neck, provide focused beam spots sufficiently small to prevent significant loss in picture resolution, particularly at high beam current levels.

Another class of lenses, the unipotential type, has also long been known. The term "unipotential lens" is used herein to mean a lens whose axial potential distribution is substantially saddle-shaped and in which the potentials at the beginning and end of the lens are substantially equal. The axial potential distribution in such a lens decreases monotonically from an initial relatively high potential near the electron source to a relatively low potential and then increases monotonically to a final, relatively high potential. See the FIG. 7B diagram. The prefix "unit" refers to the fact that the final potential is the same as the initial potential.

Although the unipotential-type lens has achieved commerical success, it does possess an unattractive drawback related to tube internal arcing. To understand the nature of this drawback, consider that the electron source in an electron gun of the type commonly employed in cathode ray tubes comprises, along the gun axis, a cathode and two conductive grids — a negative control grid, often described as the "$G_1$" electrode, and a first anode grid, commonly termed "$G_2$". The $G_2$ grid is typically excited with an applied DC voltage having a magnitude less than 1 KV (1000 volts).

The potential of the first focus lens electrode, commonly termed "$G_3$", of a unipotential-type lens is, however, very large by comparison — typically 25–30 KV. The physical separation between $G_2$ and $G_3$ is typically so small, considering the very high applied voltage difference therebetween, as to create an undesirably great tendency of arcing between $G_2$ and $G_3$. Arcing is undesirable because it is apt to damage the gun or the driving circuitry in the associated television receiver. Arcing in the electron source region is particularly undesirable since it may cause damage to the fragile cathode emission surface.

The arcing problem in a unipotential focus lens can not be overcome by simply increasing the physical separation between $G_2$ and $G_3$ since to do so could deteriorate the electron optical characteristics in the electron source region (cathode, $G_1$, $G_2$ to $G_3$ region), or could expose the beam to extraneous external fields.

The bipotential-type lens has the important advantage over unipotential-type lenses of having a reduced susceptibility to arcing, since its initial electrode receives a much lower potential, relative to the grid $G_2$ potential, than does the initial electrode of a unipotential-type lens. Yet another advantage of a bipotential lens is that for a given gun length it generally produces less electron optical magnification.

Still another type of lens found in the prior art (although not in the marketplace) is the periodic extended field type described for example in U.S. Pat. No. 3,702,950 and shown diagrammatically in FIG. 7C.

The focus lens provided according to the present invention takes advantage of the low aberrations produced by the extended field lens described and claimed in the referent U.S. Pat. No. 3,895,253 of J. Schwartz et al. As pointed out in that patent, it can be shown that lens aberrations depend largely on the value of the line integral of the quantity $$\left[ \frac{(V_0'')^2}{(V_0)^{3/2}} \right] r^2$$

where $V_0$ is the axial potential distribution in the lens, $V_0''$ is the second derivative of $V_0$, and $r$ is the beam radius. Therefore, it follows that large values of $V_0''$ are particularly harmful in regions where the axial potential $V_0$ is low or where beam radius is large. As in the lens of the referent patent, for the extended field lens of this invention, $V_0''$ is substantially less over the entire lens length and is especially low in regions of low axial potential. Furthermore, the maximum values of $V_0''$ are substantially reduced. A diagrammatical representation of the axial potential distribution of a Schwartz et al focus lens is shown in FIG. 7D.

It is noted at this time that the focusing field of the extended field lens as taught by Schwartz et al is axially continuously active. Consider the following — a reduction in $V_0''$ alone, especially in regions of low axial potential, might be achieved with a "composite lens" formed by placing two bipotential lenses essentially back to back separated by some predetermined axial distance. However, any reduction in $V_0''$ would also likely be accomplished by the establishment of a drift region or inactive focusing region at the composite lens center due to the axial separation of the bipotential lenses.

The net result of the application of the aforedescribed Schwartz et al principles is an extended field lens in which the focusing field is spread out along the axis of the lens so that $V_0$ varies smoothly and gradually over its entire range. The desired field characteristic can be established in the paraxial region of a very large diameter lens, however it has not been possible until the invention described in the referent copending Schwartz et al application to achieve the desired field characteristic in a lens having a small diameter. It has been found that by keeping the quantity $V_0''$ as small as possible in regions where $V_0$ is small or where the beam diameter is large, the necessary focusing power can be achieved while suppressing the total spherical aberration produced.

It has been concluded that if high picture brightness (implying relatively high beam currents) and high resolution (implying relatively small focused beam spot size) are simultaneously desired, one must look to something other than the standard bipotential or unipotential lenses. These objectives are met by the present invention. The invention will be described at length below; however, in order to quickly place the invention in the context of the FIGS. 7A–7D diagrams, reference may be had to FIG. 7E which reveals the very novel axial potential distribution of an exemplary focus lens constructed according to the teachings of this invention.

OBJECTS OF THE INVENTION

It is an object of the present invention to provide an electron gun for a cathode ray tube having an electrostatic focus lens which provides improved electron beam spot size performance even at high beam currents, and yet which has a reduced tendency to arc.

It is another object to provide an electron gun having a focus lens of the extended field type which is an improvement on prior art lenses of this type in terms of the number of parts required, in the axial lens length, and in excitation voltage logistics.

It is still another object to provide an electron gun having a focus lens which is neither of the bipotential or unipotential types, and yet which possesses the favorable properties of each without also suffering the shortcomings thereof.

More specifically, it is an object to provide a lens which has the relatively favorable high current spot size performance of unipotential-type lenses and yet which has the reduced susceptibility to arcing and low magnification inherent in bipotential-type lenses.

STATE OF THE ART

The following patents illustrate the state of the art:

| U. S. Patents | |
|---|---|
| 2,859,387 | Gundert |
| 3,504,225 | Shimada et al |
| 2,484,721 | Moss |
| 3,467,881 | Ohgoshi |
| 3,448,316 | Yoshida et al |
| 3,651,359 | Miyaoka |
| 3,652,896 | Miyaoka |
| 3,786,302 | Veith |
| 3,777,210 | Spaulding |
| 3,767,953 | Bossers |
| 3,740,607 | Silzars et al |
| 3,702,950 | Nakamara |
| 3,651,359 | Miyaoka |
| 3,603,839 | Takayanagi |
| 3,732,457 | Veno et al |
| 3,714,504 | Amboss |

-continued

| U. S. Patents | |
|---|---|
| 3,786,302 | Veith |

WEST GERMAN PATENTS

OLS 2,264,113
OLS 2,318,547

PUBLICATIONS

*Popular Mechanics*, May, 1974, pages 87–88.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with the accompanying drawings, in the several figures of which like reference numerals identify like elements, and in which:

FIGS. 7A–7D represent prior art structures, FIG. 7E the present invention.

DESCRIPTION OF THE PREFERRED EMBODIMENT

Before discussing in detail the preferred embodiments of the invention, an explanation of certain principles underlying the invention will first be engaged. As suggested above, an optimally designed unipotential-type focus lens will normally produce less spherical aberrations than a bipotential-type focus lens. The reason for this is that in a bipotential lens the first lens electrode adjacent the beam cross-over produced by the electron source (the cathode and its associated grid system) is at a relatively low potential, typically 5 to 6 KV. This permits the beam emerging from the beam cross-over to spread rapidly and fill a large portion of the lens.

By contrast, the first electrode of a unipotential-type focus lens (the electrode closest to the cathode/first grid/second grid system) is at a substantially higher potential, typically 25–30 KV. Due to this large initial lens electrode potential, the beam does not expand as rapidly, and does not fill the lens to as great an extent as in a bipotential-type lens.

Thus it is seen that the advantage of having a relatively high potential on the initial lens electrode is to reduce beam spreading in the lens which in turn results in reduced spherical aberration. As a general rule, spherical aberration rapidly increases with increasing ratios of maximum beam diameter to maximum lens diameter, i.e., spherical aberration is a function of "lens filling".

Another factor must be considered — the magnification by the focus lens of the beam cross-over. Magnification produced by an electron lens is a function of the potential existing in the region between the beam cross-over and the main focusing field. Since this potential is significantly less for a bipotential-type lens than for a unipotential-type lens, it is apparent that a bipotential-type lens is superior to a unipotential-type lens in terms of the cross-over magnification produced. It is an object of this invention to provide an electron gun having a focus lens which exploits the desirable properties of both the bipotential and unipotential-type focus lenses.

Figure 1:
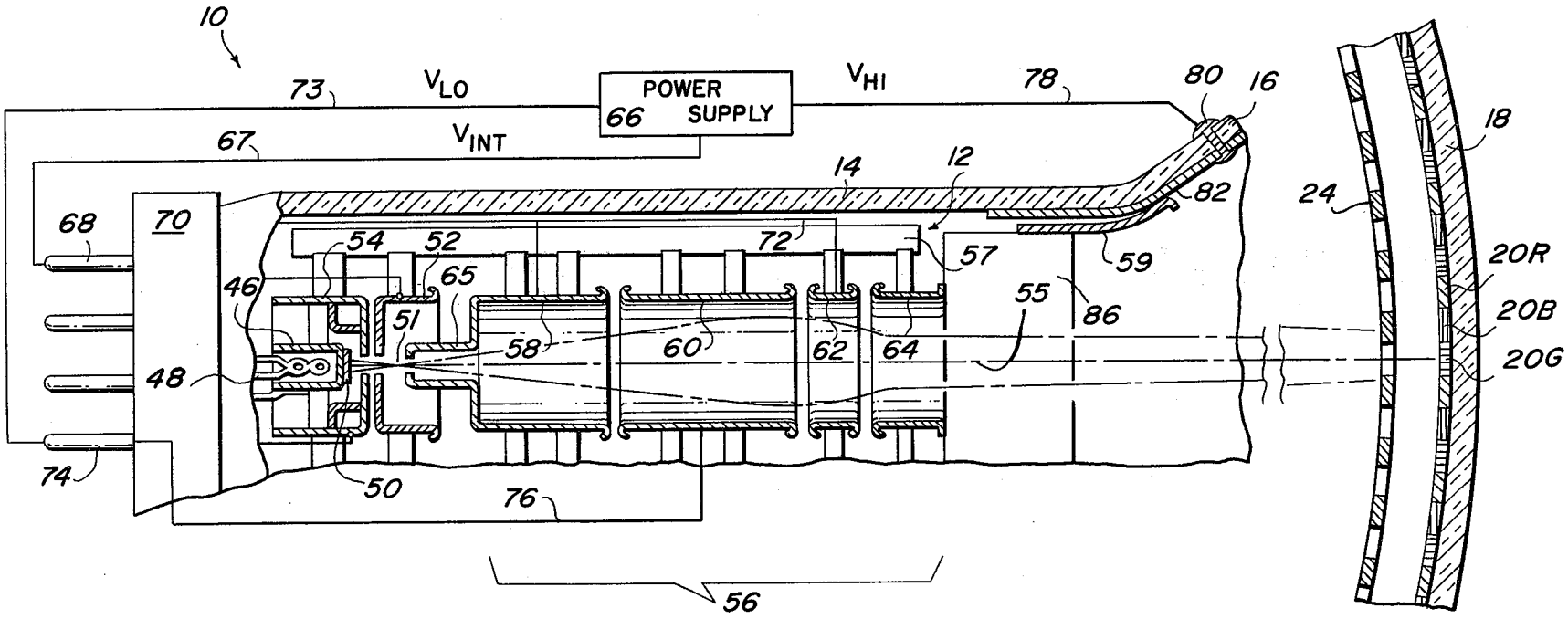
FIG. 1 is a partially sectioned, fragmentary side elevation view of a color television cathode ray tube embodying a novel electron gun constructed according to the principles of this invention.

FIG. 1 illustrates in schematic form a color television tube 10 having incorporated therein three novel electron guns (one of which is shown at 12) implementing the principles of this invention. The television tube 10 is illustrated as comprising a neck 14 containing the electron guns 12 which is joined to a funnel 16. The funnel 16 constitutes a portion of the tube envelope and is joined with a faceplate 18 to form a vacuum enclosure. On the inner surface of the faceplate 18 is disposed a phosphor screen comprising a pattern of interlaced red-emissive, blue-emissive and green-emissive phosphor elements 20R, 20B and 20G. Although the principles of this invention may be applied to the construction of electron guns of general applicability in color and black-and-white television tubes, the illustrated tube 10 is shown as being a color tube of the shadow mask variety, including a shadow mask 24 disposed adjacent the faceplate 18. As is well known, a shadow mask is designed to act as a parallax barrier to assure proper registration of the red-associated, blue-associated and green-associated electron beams with the red-emissive, blue-emissive and green-emissive phosphor elements, respectively, on the screen.

The electron gun 12 shown in FIG. 1 will now be described in detail. The electron gun 12 may be thought of as comprising two basic components — an electron source and a focus lens. In the illustrated FIG. 1 embodiment the electron source comprises cathode means — here shown as a cathode sleeve 46, heater coil 48 and emissive layer 50, from which emitted electrons are focused to a cross-over 51 by the effect of a grid 52, commonly termed the $G_2$ grid. A control grid 54 (the $G_1$ grid) is operated at a negative potential relative to the cathode and serves to control intensity of the electron beam in response to the application of a video signal thereto, or to the associated cathode. The electron source for generating the beam cross-over 51 may be of conventional construction and operation.

In accordance with this invention there is provided novel focus lens means which receives electrons from a cathode, preferably from a beam cross-over as shown at 51, and a predetermined pattern of supply voltages to form at a distance from the gun, namely at the screen of the tube 10, a focused beam spot — here a real image of the beam cross-over 51. The novel focus lens means in accordance with this invention comprises at least three electrodes for establishing an electrostatic focusing field characterized by having an axial potential distribution which varies monotonically from a relatively intermediate potential to a relatively low potential spatially located at a lens intermediate position, and then varies monotonically from the relatively low potential to a final relatively high potential. Preferably, in television applications such as depicted in FIG. 1, the described axial potential distribution is in the direction of electron beam flow. That is, the relatively intermediate potential is established nearest to the cathode and the relatively high potential is nearest to the screen. Alternatively, in other television applications such as in post-deflection focus type tubes, it may be desirable to reverse the orientation of the lens — i.e., to establish the relatively high potential toward the cathode with the relatively intermediate potential being at the end of the lens nearest the screen.

In the illustrated preferred embodiment shown in FIG. 1, the lens 56 comprises a first lens electrode 58, a second lens electrode 60, a third lens electrode 62 and a fourth lens electrode 64. In the interest of ease of fabrication and economy the electrodes are preferably, although not necessarily, constructed of conventional tubular stock with a common inner diameter. The lens electrodes 58–64 are arranged coaxially with appropriate small gaps between them. A neck 65 on electrode 58 provides beam shielding and electric field shaping in the final portions of the electron source region.

A power supply 66 is illustrated schematically for generating a relatively intermediate supply voltage $V_{INT}$, a relatively low supply voltage $V_{LO}$, and a relatively high supply voltage $V_{HI}$. The relatively intermediate supply voltage $V_{INT}$ is applied by means of conductor 67, a pin 68 in the base 70 of the neck 14, and a conductive lead network 72, to the first and third lens electrodes 58, 62. A relatively low supply voltage $V_{LO}$ is applied through conductor 73, pin 74 and conductive lead 76 to the second lens electrode 60.

A relatively high supply voltage $V_{HI}$ is applied to the fourth lens electrode 64 by means of a conductor 78, an anode button 80, a conductive coating 82 on the inner surface of the envelope, a conductive snubber spring 59 engaging the coating 82, and a convergence cage 86 electrically united with the fourth electrode 64. The relatively high supply voltage $V_{HI}$ is preferably the screen or ultor voltage, applied to the screen through anode button 80, and conductive coating 82.

Static convergence of three of the guns 12 may be effected conventionally, e.g., magnetically, electrostatically or by physical convergence of the gun axes 55 at the screen. Support structures for effecting alignment of the gun axes may be conventional; these include electrode support pillars (one of which is shown at 57), a snubber spring 59, and other conventional structures not shown.

In accordance with the preferred implementation of the principles of this invention, the relatively intermediate supply voltage $V_{INT}$ is applied to an initial electrode of the lens 56, here shown as the first electrode 58, and is within the range of about 25% to 60% of the relatively high supply voltage $V_{HI}$. Although such is not necessary to a successful implementation of this invention, the illustrated embodiment shows the same relatively intermediate voltage being also applied to the third electrode 62. In other embodiments of this invention wherein simplicity of construction is favored over performance, the third electrode may be eliminated altogether. Alternatively, it may receive some other intermediate applied voltage.

In the interest of simplifying the power supply 66 and of minimizing the logistics of the supply voltages, it is desirable that where intermediate voltages are to be applied to initial and intermediate electrodes in the lens, that such voltages be of the same value.

In the illustrated preferred FIG. 1 embodiment, it is desirable that the relatively low supply voltage $V_{LO}$ be within the range of about 10% to 30% of the relatively high supply voltage $V_{HI}$, but always less than the intermediate voltage $V_{INT}$. By way of a specific example, the voltage applied to the first and third electrodes 58, 62 may be about 12 KV, the supply voltage applied to the second electrode 60 may be about 5.8 KV, and the supply voltage applied to the fourth electrode 64 may be about 30 KV.

In order to produce an extended field lens implementing the principles of this invention, it is important also that the lengths of the lens electrodes 58–64 relative to their diameters and relative to each other be predetermined. In the illustrated preferred FIG. 1 embodiment, the first lens electrode 58 may have a length-to-inner diameter ratio of about 0.5 to 3.0. The second electrode 60 preferably has a length-to-inner-diameter ratio of about 0.5 to 2.2. The third electrode 62 preferably has a length which is less than about 0.75 times its inner diameter. The length of the fourth electrode 64 is not critical provided it is long enough to complete the lens field.

Following is a further detailing of structural specifications for an operative lens of the preferred four-element type shown in FIG. 1. The dimensions given represent those for a gun for use in a tube of the "large neck" type with guns of delta arrangement; length of electrode 58 (without neck 65) — 0.430 inch; length of electrode 60 — 0.500 inch; length of electrode 62 — 0.165 inch; length of electrode 64 – 0.300 inch; inter-electrode gaps — 0.030 inch; electrode inner diameter — 0.353 inch.

Figure 2:
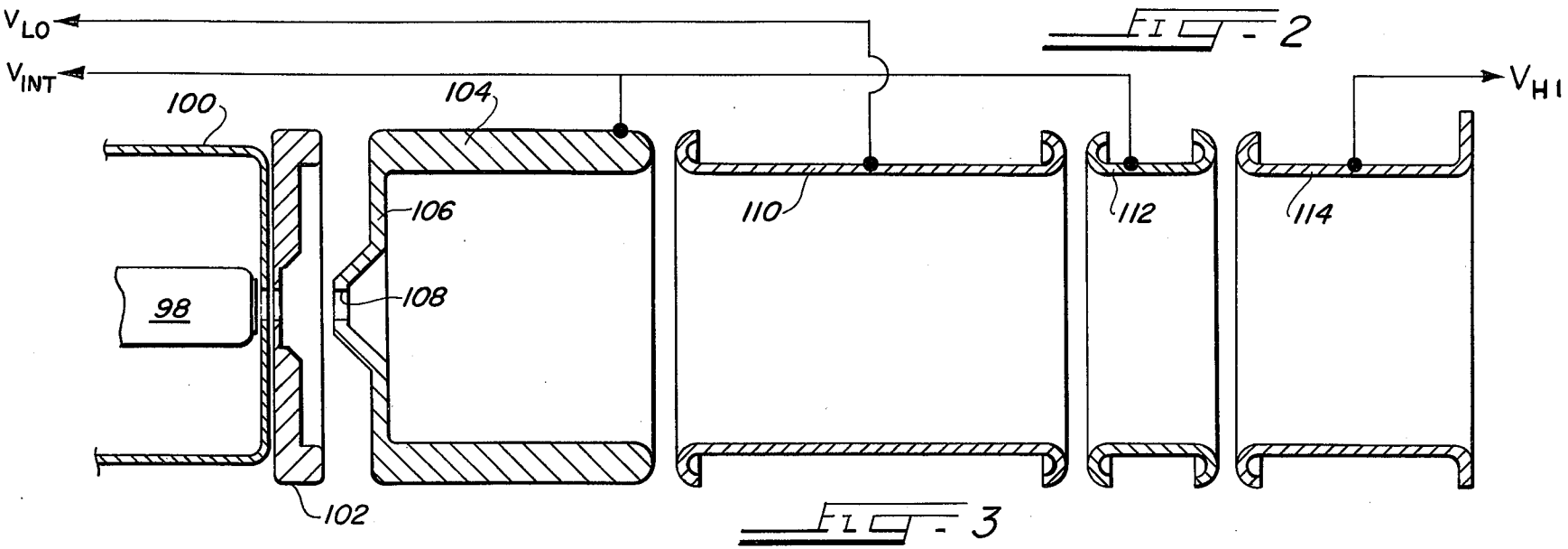
FIG. 2 illustrates an alternate preferred embodiment of an electron beam focus lens constructed according to this invention.

Whereas for reasons of economy, tubular electrodes as shown in the FIG. 1 embodiment are preferred, other electrode structures may be employed, as shown for example in the FIG. 2 embodiment. The FIG. 2 embodiment is illustrated as comprising a cathode structure 98, a tubular $G_1$ electrode 100, and a configured $G_2$ electrode 102. A novel focus lens in accordance with this invention is illustrated as comprising a first electrode 104 having a rear wall 106 which is convexly curved toward the electron beam source and has an aperture 108 for passing the electron beam. Second, third and fourth electrodes are shown at 110, 112 and 114 and are illustrated as being of the tubular type. The typical electrode dimension and spacings and applied voltages given above with respect to the FIG. 1 embodiment may be employed in the construction and operation of the FIG. 2 gun embodiment.

Figure 3:
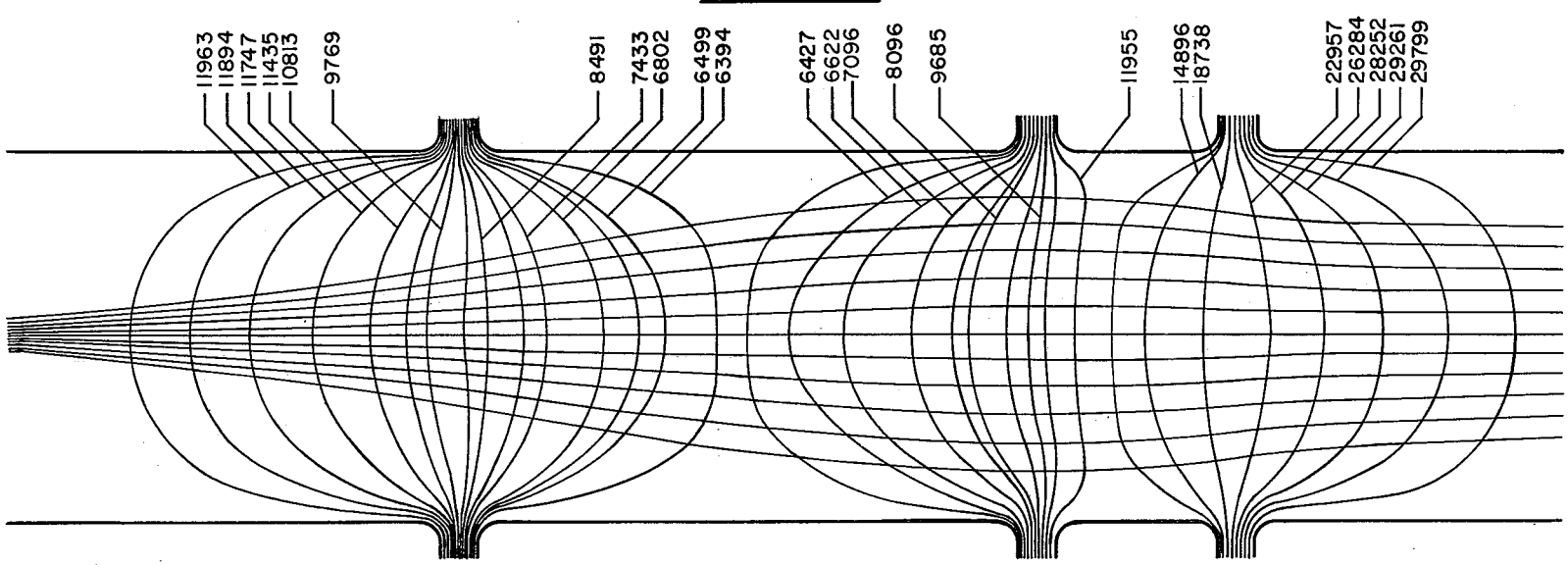
FIG. 3 is a computer plotted diagram of electric field equipotential lines and electron ray traces for the focus lens of FIG. 2.

FIG. 3 is a computer plot which represents the nature of the pattern of equipotential lines and the electron trajectories which might be expected to occur in a focus lens as shown in FIG. 2 having generally the dimensions and operating voltages given above with respect to the FIG. 1 embodiment. The FIG. 3 plot clearly shows the extended, continuously active nature of the focusing field established and the reduced filling of the lens by the electron beam. The FIG. 3 plot also clearly shows that a component of the focusing field is established between each of the four electrodes and its neighboring electrode as a result of the potential difference established between neighboring electrodes. FIG. 3 also depicts the substantially field free region established at the cathode end of the first electrode which acts to separate the pre-focus region of the gun from the focus lens of the gun. The separation of the focus lens from the beam cross-over is important since the greater this distance, the less the cross-over magnification produced by the focus lens.

Figure 5:
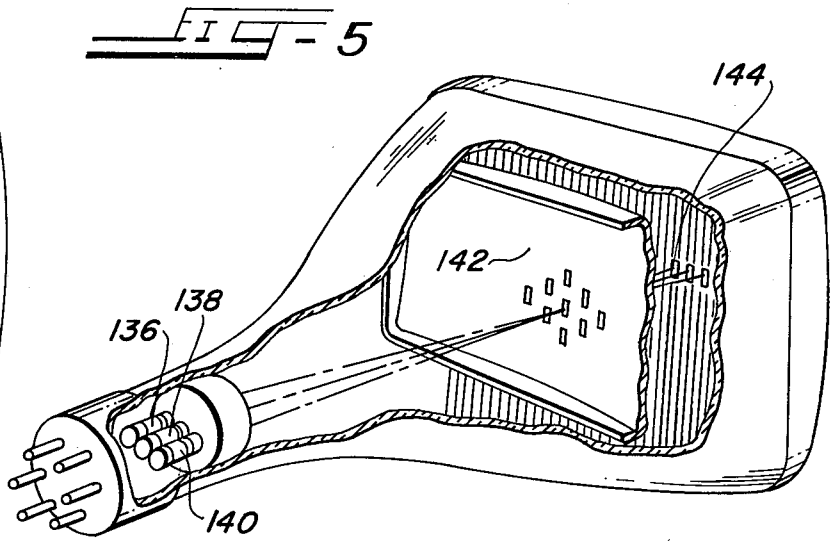
FIGS. 4 and 5 illustrate dot screen/delta gun and line screen/in-line gun color tubes of the shadow mask type in which the principles of this invention may be incorporated.
Figure 4:
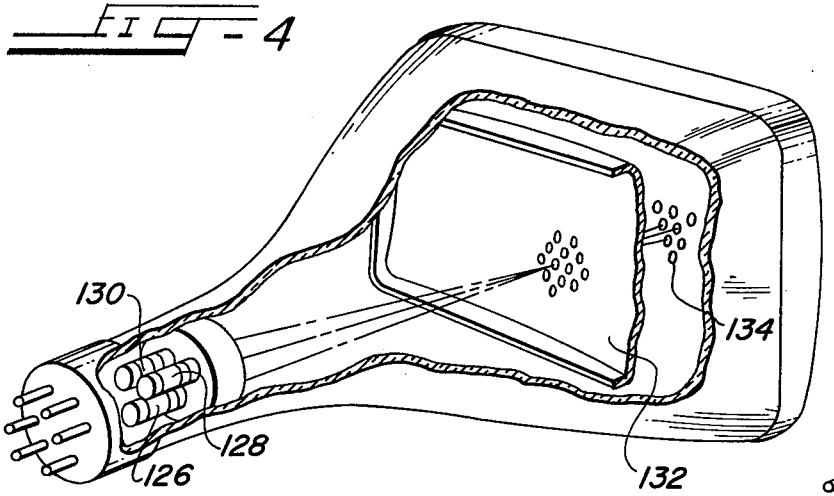

The principles of the invention are thought to be especially useful in television tubes of the delta gun/dot mask/dot screen type as shown in FIG. 4, and in color television tubes of the in-line gun/slot mask/line screen type as shown in FIG. 5. In FIG. 4 the electron guns are shown in a "delta" arrangement at 126, 128 and 130. A shadow mask 132 of the dot-type is shown as cooperating with a screen 134 of the dot type. In the FIG. 5 illustration, the electron guns are shown as being arranged in a coplanar, horizontal "in-line" arrangement at 136, 138 and 140. The shadow mask 142 is of the "slot" type, cooperating with a screen of the type having repetitively arranged, vertically oriented, red-emissive, blue-emissive, and green-emissive phosphor strips 144. It should also be appreciated that electron guns following the teachings of the present invention are also useful in color picture tubes which employ only a single beam or in other single beam cathode ray devices.

Figure 6:
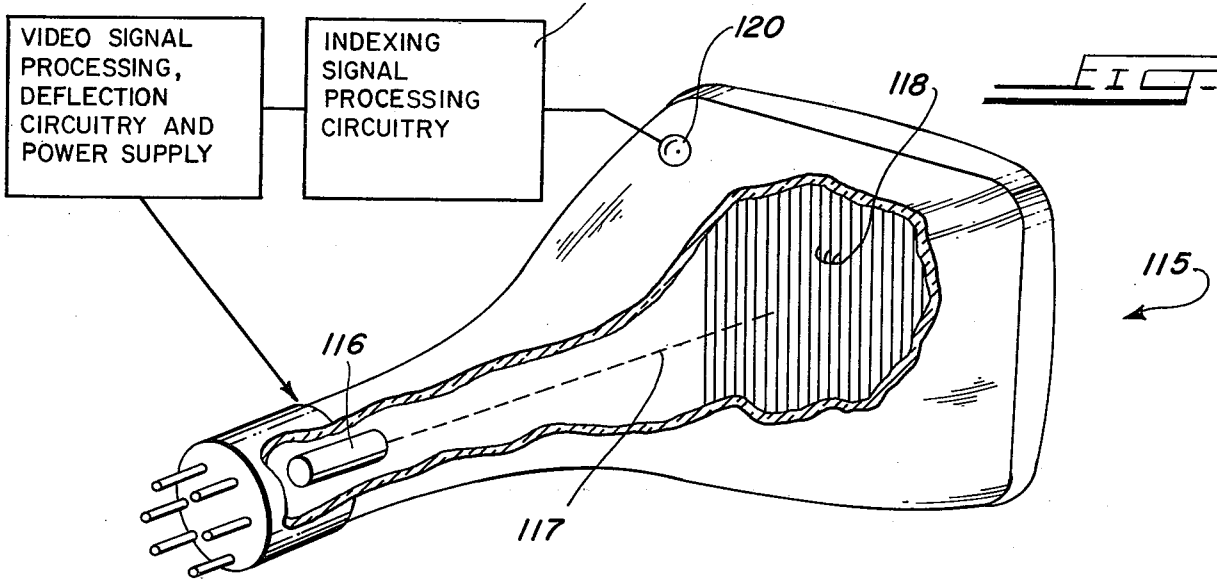
FIG. 6 illustrates application of the invention in a beam-index type tube.
Figures 7A, 7B, 7C, 7D, 7E:
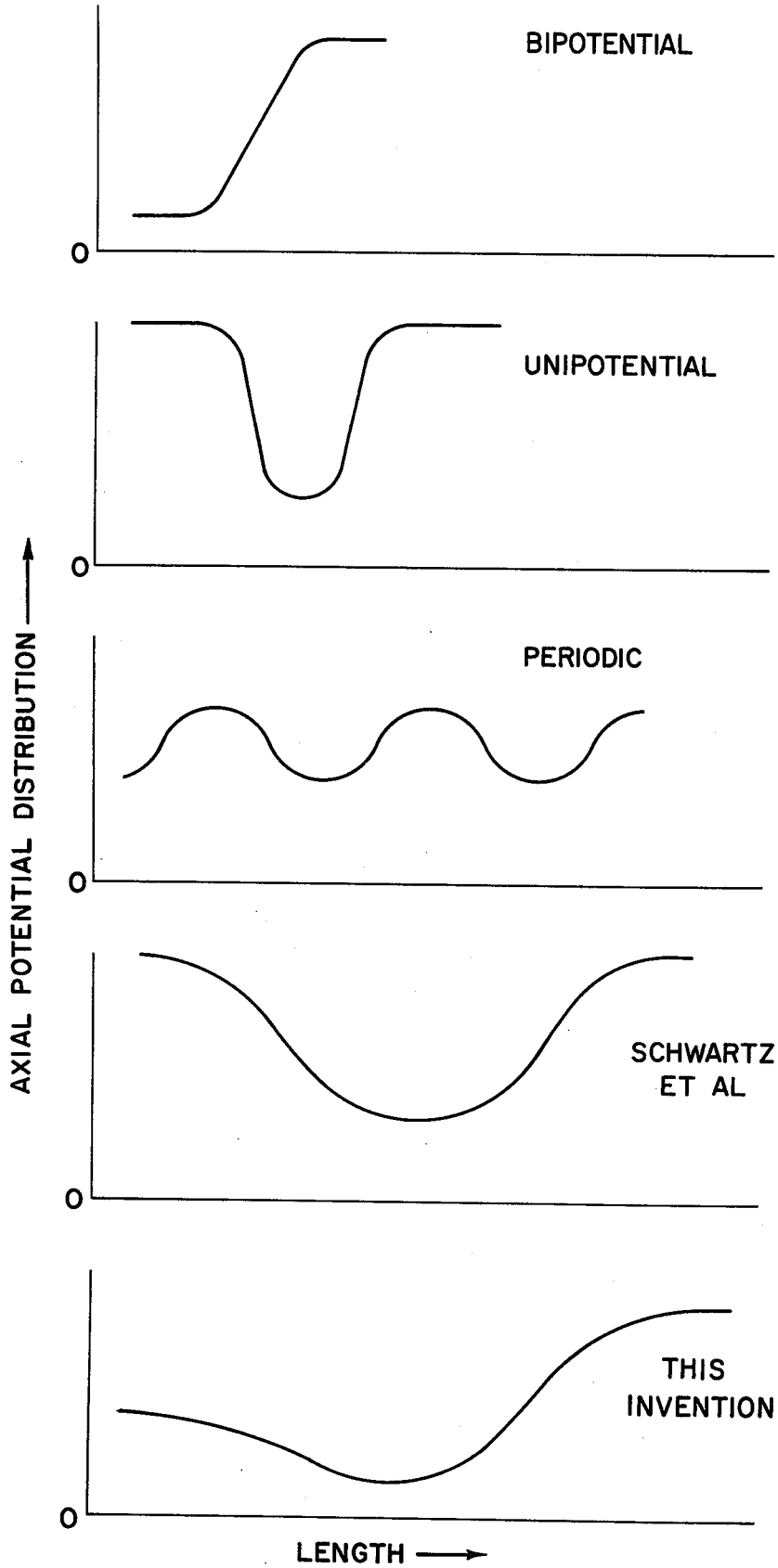
FIG. 7A PRIOR ART
FIG. 7B PRIOR ART
FIG. 7C PRIOR ART
FIG. 7D PRIOR ART
FIGS. 7A–7E are diagrammatical representations of axial potential distribution-versus-length in various cathode ray tube focus lens structures.

As a further example, the invention may be employed in a color tube 115 of the "beam index" type, shown schematically in FIG. 6, which utilizes a single electron gun 116 to generate a single beam 117. In this type of tube, a single gun is normally caused to sequentially excite vertically oriented red-emitting, blue-emitting and green-emitting phosphor strips 118 on the face-plate of the tube. In order that the color information impressed on the electron beam 117 is synchronized with irradiation of the phosphor strips 118 as the beam 117 is deflected across the screen, there is provided at periodical intervals across the screen strips of indexing material which are excited by the electron beam. The indexing strips (not shown) may be of a variety of types, such as those which when excited by electrons emit ultra-violet radiation. In this type of tube, the ultra-violet radiation is sensed by a photodetector, shown schematically as 120. The photodetector 120 is coupled to processing circuitry 122 which develops an indexing signal used to control the electron beam modulation and assure its coordination with the color information carried on the beam 117. An electron gun according to this invention is especially useful in an index tube of small size wherein the limited available space in the neck militates against the small spot size which must be developed in an index tube. By the application of this invention, an electron gun having the necessarily small diameter can be constructed which is capable of producing an acceptably small beam spot size.

As suggested above, wherein simplicity of construction is desired over performance, the principles of the invention may be employed in a three electrode embodiment wherein the first electrode is appropriately structured and receives a relatively intermediate supply voltage, wherein the second electrode is appropriately structured and receives a relatively low supply voltage and wherein the third electrode is appropriately structured and receives a relatively high supply voltage. Guns having three electrode focus lenses of the type described, however, are not preferred for the reason that their spot size performance is not as good as that achieved by the preferred four-electrode embodiments described above.

Further, in applications wherein performance is favored over complexity of construction and cost, focus lenses implementing the principles of this invention with five or more electrodes may be employed. For example, a five electrode lens might have five appropriately configured and spaced electrodes receiving supply voltages having the following pattern, in the direction of electron beam flow: $V_{INT}$, $V_{LO}$, $V_{LO\text{-}INT}$, $V_{HI\text{-}INT}$, and $V_{HI}$. It has been found however that a four electrode focus lens is a practical compromise between mechanical complexity and gun performance.

Whereas in each of the embodiments described above, a discrete electron gun for generating a single electron beam is described, the principles of this invention may be readily adapted in "unitized" gun structures wherein a plurality of beams are produced by a composite electron gun structure in which commonality of parts is achieved. Whereas the above-described embodiments utilize tubular type electrodes, and whereas such electrode configurations are favored, the principles of the invention may be implemented utilizing electrodes of the disc type. In each of the embodiments constructed according to this invention the pattern of applied voltages in the electrode structural configurations and spacings is caused to be such that the axial potential distribution varies monotonically from a relatively intermediate potential to a relatively low potential and then varies monotonically from the said relatively low potential to a relatively high potential.

Whereas the novel focus lenses of this invention have been described above as focusing the beam on the screen of the containing tube, it is to be understood that in certain tube types, the focus lens may be focused in front of or behind the screen. Further, whereas special emphasis has been placed on using the principles of this invention in guns of the small-diameter type which are clustered in the neck of a cathode ray tube, it is to be understood that if the constraint on lens diameter were relieved, a large diameter lens could be constructed according to this invention which would have substantially improved spot size performance.

Still other changes may be made in the above-described methods and apparatus without departing from the true spirit and scope of the invention herein involved and it is intended that the subject matter in the above depiction shall be interpreted as illustrative and not in a limiting sense.

What is claimed is:

1. An electron gun for a television cathode ray tube, having associated therewith a power supply for developing gun supply voltages, said electron gun receiving supply voltages from said power supply to produce a focused beam of electrons, said gun comprising associated cathode means and grid means for producing a beam of electrons, and a low aberrations, low magnification main focus lens means for receiving electrons from said cathode means and a predetermined pattern of voltages from the power supply to form at a distance an electron beam spot which is small even at high beam currents, said main focus lens means comprising at least three main focus electrodes for establishing a single, continuous electrostatic focusing field characterized by having an axial potential distribution which, at all times during tube operation, decreases smoothly and monotonically from a relatively intermediate potential to a relatively low potential, i.e., a potential which is many kilovolts lower than said relatively intermediate potential, spatially located at a lens intermediate position, and then increases smoothly, directly and monotonically from said relatively low potential to a relatively high potential, i.e., a potential which is many kilovolts higher than said relatively intermediate potential, the potential difference between each of said main focus electrodes establishing significant main focusing field components.

2. The electron gun defined by claim 1 wherein said axial potential distribution is established in the direction of electron beam flow, the relatively intermediate potential being located nearest the cathode means.

3. The electron gun defined by claim 1 wherein said axial potential distribution is established in a direction opposite to the direction of electron beam flow, the relatively high potential being located nearest to the cathode means.

4. An electron gun for a television cathode ray tube, having associated therewith a power supply for developing gun supply voltages, said electron gun receiving supply voltages from said power supply to produce a beam of electrons focused on a screen of the tube, said gun comprising:

electron source means comprising cathode means and grid means for producing a beam cross-over; and a low aberrations, low magnification main focus lens means for receiving electrons from said beam cross-over and a predetermined pattern of relatively intermediate, relatively low and relatively high supply voltages from the power supply to form at the screen of the tube a real image of said beam cross-over which is small even at high beam currents, comprising at least three electrodes for establishing a single, continuous electrostatic focusing field characterized by having an axial potential distribution which, in the direction of electron beam flow and at all times during tube operation, decreases smoothly and monotonically from an initial, relatively intermediate potential near said electron source means to a relatively low potential, i.e., a potential which is many kilovolts lower than said relatively intermediate potential, spatially located at a lens intermediate position, and then increases smoothly, directly and monotonically from said relatively low potential to a final, relatively high potential, i.e., a potential which is many kilovolts higher than said relatively intermediate potential, the potential difference between each of said main focus electrodes establishing significant main focusing field components.

5. The electron gun defined by claim 4 wherein said focus lens means comprises first, second, third and fourth tubular conductive electrodes, all of approximately the same inner diameter, arranged coaxially with small gaps therebetween.

6. The electron gun defined by claim 5 wherein said second electrode has a length-to-inner-diameter ratio of about 0.5 to 2.2.

7. The electron gun defined by claim 5 wherein said third electrode has a length which is less than about 0.75 times its inner diameter.

8. The combination including the electron gun defined by claim 1 and a power supply for supplying and applying to a first main focus electrode in said lens a relatively intermediate supply voltage, to an intermediate main focus electrode in said lens a relatively low supply voltage, and to a final main focus electrode in said lens a relatively high supply voltage.

9. The combination defined by claim 8 wherein said lens comprises first, second, third and fourth axially spaced main focus electrodes, wherein said relatively high supply voltage is approximately equal to a voltage applied to the screen of the containing cathode ray tube and is applied to said fourth electrode, wherein said relatively intermediate supply voltage is within the range of about 25% to 60% of said relatively high supply voltage and is applied to said first and third electrodes, and wherein said relatively low supply voltage is within the range of about 10% to 30% of said relatively high supply voltage but always lower than said relatively intermediate supply voltage and is applied to said second electrode.

10. The combination defined by claim 9 wherein said relatively intermediate supply voltage is about 12 kilovolts, said relatively low supply voltage is about 5.8 kilovolts and said relatively high supply voltage is about 30 kilovolts.

11. An electron gun as defined in claim 1 wherein said relatively high potential is substantially the same as the voltage applied to the screen of the containing cathode ray tube, wherein said relatively low potential is within the range from about 10% to 30% of said screen voltage and wherein said relatively intermediate potential is within the range of from about 25% to 60% of said screen potential but never less than said relatively low potential.

12. For use in association with a color television cathode ray tube of the small neck, shadow mask type, the combination comprising:

power supply means for developing a relatively intermediate supply voltage, a relatively low supply voltage, i.e., a voltage which is many kilovolts lower than said relatively intermediate supply voltage, and a relatively high supply voltage, i.e., a voltage which is many kilovolts higher than said relatively intermediate supply voltage; and electron gun means for generating in the tube neck an in-line or delta cluster of red-associated, blue-associated and green-associated electron beams individually focused at the screen of the tube, comprising:

electron source means comprising cathode means and grid means for producing three separate beam cross-overs, one for each electron beam, and three low aberrations, low magnification main focus lens means coupled to said power supply means for receiving electrons from said beam cross-overs and for individually focusing said cross-overs at the tube screen to form spots which are small even at high beam currents, said focus lens means including, for each beam, first, second, third and final axially spaced main focus electrode means, said first and third electrode means receiving said relatively intermediate supply voltage, said second electrode means receiving said relatively low supply voltage, and said final electrode means receiving said relatively high supply voltage for establishing an electrostatic focusing field characterized by having a single, continuous axial potential distribution which, in the direction of electron beam flow and at all times during tube operation, decreases smoothly and monotonically from an initial, relatively intermediate potential near said electron source means to a relatively low potential spatially located at a lens intermediate position, and then increases smoothly, directly and monotonically from said relatively low potential to a final, relatively high potential.

13. The electron gun defined by claim 12 wherein said first electrode has a length-to-inner-diameter ratio of about 0.5 to 3.0.

14. The electrode gun defined by claim 12 wherein said second electrode has a length-to-inner-diameter ratio of about 0.5 to 2.2.

15. The electron gun defined by claim 12 wherein said third electrode has a length which is less than about 0.75 times its inner diameter.

16. An electron gun for a television cathode ray tube, having associated therewith a power supply for developing gun supply voltages, said electron gun receiving supply voltages from said power supply to produce a beam of electrons focused on a screen of the tube, said gun comprising:

electron source means comprising cathode means and grid means for producing a beam cross-over; and a low aberrations, low magnification main focus lens means for receiving electrons from said beam cross-over and a predetermined pattern of relatively intermediate, relatively low and relatively high supply voltages from the power supply to form at the screen of the tube a real image of said beam cross-over which is small even at high beam currents, comprising first, second, third and fourth tubular conductive electrodes, all of approximately the same inner diameter, arranged coaxially with small gaps therebetween, said first electrode having a length-to-inner-diameter ratio of about 0.5 to 3.0, said main focus lens means establishing a single, continuous electrostatic focusing field characterized by having an axial potential distribution which, in the direction of electron beam flow and at all times during tube operation, decreases smoothly and monotonically from an initial, relatively intermediate potential near said electron source means to a relatively low potential, i.e., a potential which is many kilovolts lower than said relatively intermediate potential, spatially located at a lens intermediate position, and then increases smoothly, directly and monotonically from said relatively low potential to a final, relatively high potential, i.e., a potential which is many kilovolts higher than said relatively intermediate potential, the potential difference between each of said main focus electrodes establishing significant main focusing field components.

17. For use in association with a color television cathode ray tube of the small neck, shadow mask type, the combination comprising:

power supply means for developing a relatively intermediate supply voltage which is within the range of about 25% to 60% of the voltage applied to the screen of the tube, a relatively low supply voltage, i.e., a voltage which is many kilovolts lower than said relatively intermediate supply voltage and is within the range of about 10% to 30% of the voltage applied to the screen of the tube, and a relatively high supply voltage, i.e., a voltage which is many kilovolts higher than said relatively intermediate supply voltage and approximately equal to the voltage applied to the screen of the tube; and electron gun means for generating in the tube neck an in-line or delta cluster of red-associated, blue-associated and green-associated electron beam individually focused at the screen of the tube, comprising:

electron source means comprising cathode means and grid means for producing three separate beam cross-overs, one for each electron beam, and three low aberrations, low magnification main focus lens means coupled to said power supply means for receiving electrons from said beam cross-overs and for individually focusing said cross-overs at the tube screen to form spots which are small even at high beam currents, said focus lens means including, for each beam, discrete first, second, third and final axially spaced main focus electrode means, said first and third electrode means receiving said relatively intermediate supply voltage, said second electrode means receiving said relatively low supply voltage, and said final electrode means receiving said relatively high supply voltage for establishing an electrostatic focusing field characterized by having a single, continuous axial potential distribution which, in the direction of electron beam flow and at all times during tube operation, decreases smoothly and monotonically from an initial, relatively intermediate potential near said electron source means to a relatively low potential spatially located at a lens intermediate position, and then increases smoothly, directly and monotonically from said relatively low potential to a final, relatively high potential.

18. The electron gun defined by claim 17 wherein said relatively intermediate supply voltage is about 12 kilovolts, said relatively low supply voltage is about 5.8 kilovolts and said relatively high supply voltage is about 30 kilovolts.

19. An electron gun for use in a television cathode ray tube comprising:

electron source means comprising cathode means and grid means for producing a beam cross-over;

a low aberrations, low magnification main focus lens means for receiving electrons from said beam cross-over for forming at a distance a real image of said beam cross-over which is small even at high beam currents, comprising, with small axial gaps therebetween, first, second, third and fourth coaxial main focus electrodes, sequentially arranged with said first electrode being nearest to said electron source;

first electrically conductive means for receiving a relatively intermediate supply voltage and for interconnecting said first and third electrodes and for applying said intermediate voltage to said first and third electrodes;

second electrically conductive means for receiving a relatively low supply voltage, i.e., a potential which is many kilovolts lower than said relatively intermediate potential, and for applying it to said second electrode; and third electrically conductive means for receiving a relatively high supply voltage, i.e., a potential which is many kilovolts higher than said relatively intermediate potential, the potential difference between each of said main focus electrodes establishing significant main focusing field components and for applying it to said fourth electrode.

20. The electron gun defined by claim 19 wherein said first electrode has a length-to-inner-diameter ratio of about 0.5 to 3.0.

21. The electron gun defined by claim 19 wherein said second electrode has a length-to-inner-diameter ratio of about 0.5 to 2.2.

22. The electron gun defined by claim 19 wherein said third electrode has a length which is less than about 0.75 times its inner diameter.

23. An electron gun as defined in claim 19 wherein said relatively high supply voltage is substantially the same as the cathode ray tube screen voltage, said relatively low supply voltage is within the range from about 10% to 30% of said screen voltage, and said intermediate supply voltage is within the range from about 25% to 60% of said screen voltage, but always greater than said relatively low supply voltage.

24. An electron gun as defined by claim 19 wherein said relatively intermediate supply voltage is about 12 kilovolts, said relatively low supply voltage is about 5.8 kilovolts and said relatively high supply voltage is about 30 kilovolts.

25. An electron gun for a television cathode ray tube of the beam index type, having associated therewith a power supply for developing gun supply voltages, said electron gun receiving supply voltages from said power supply to produce a single focused beam of electrons, said gun comprising:

electron source means comprising cathode means and grid means for producing a beam cross-over; and a low aberrations, low magnification main focus lens means for receiving electrons from said beam cross-over and a predetermined pattern of relatively intermediate, relatively low and relatively high supply voltages from the power supply to form at a distance a real image of said beam cross-over which is small even at high beam currents, comprising at least three electrodes for establishing an electrostatic focusing field characterized by having an axial potential distribution which, in the direction of electron beam flow and at all times during tube operation, decreases smoothly and monotonically from an initial, relatively intermediate potential near said electron source means to a relatively low potential, i.e., a potential which is many kilovolts lower than said relatively intermediate potential, spatially located at a lens intermediate position, and then increases smoothly, directly and montonically from said relatively low potential to a final, relatively high potential, i.e., a potential which is many kilovolts higher than said relatively intermediate potential, the potential difference between each of said main focus electrodes establishing significant main focusing field components.

* * * * *